United States Patent [19]

Justice

[11] Patent Number: 4,893,365

[45] Date of Patent: Jan. 16, 1990

[54] ADJUSTABLE KING-SIZED MATTRESS

[76] Inventor: Donald R. Justice, P.O. Box 458, Matlacha, Fla. 33909

[21] Appl. No.: 354,769

[22] Filed: May 22, 1989

[51] Int. Cl.[4] ..... A61G 7/00

[52] U.S. Cl. ..... 5/68; 5/465

[58] Field of Search ..... 5/66, 68, 437, 446, 5/447, 465

[56] References Cited

U.S. PATENT DOCUMENTS

| | | | |
|---|---|---|---|
| 2,702,909 | 3/1955 | Atkins | 5/465 X |
| 3,089,150 | 5/1963 | Briggs et al. | 5/68 |
| 3,644,946 | 2/1972 | Swatt | 5/68 |
| 3,646,621 | 3/1972 | Fragas | 5/465 X |
| 3,731,327 | 5/1973 | Frey | 5/465 X |
| 3,978,530 | 9/1976 | Amarantos | 5/68 |

*Primary Examiner*—Michael F. Trettel

*Attorney, Agent, or Firm*—Fleit, Jacobson, Cohn, Price, Holman & Stern

[57] ABSTRACT

The problem of a split between two mattresses is eliminated by giving each person on a king-sized bed the capability for adjusting the head and/or foot portion of the mattress to any position, without disturbing the bed partner. A serpentine "S" design is provided to separate the head and foot portions of a single mattress at a distance extending over approximately two feet from the headboard toward the foot of the bed and extending over approximately two feet from the foot of the bed toward the headboard. There is approximately three to four feet of the mattress in a central portion without any separation where most of the body's weight is concentrated and which provides support and comfort for two people in a single king-sized mattress having adjustable head and foot portions.

7 Claims, 2 Drawing Sheets

ADJUSTABLE KING-SIZED MATTRESS

FIELD OF THE INVENTION

This invention relates to a king-sized mattress having a serpentine separation between head and foot mattress portions which extends from the top of the mattress towards the foot of the mattress and from the foot of the mattress towards the head of the mattress.

BACKGROUND OF THE INVENTION

Often times during travel, when king-sized mattresses are requested, two single-sized beds are pushed together to allow two people to sleep together. As a result, an ever-present split between the two single-sized beds proves extremely bothersome throughout the night.

In the situation where a king-sized bed is used at home or during travel, with an automatic hospital-type remote control capability to adjust the entire head or foot of the mattress to a comfortable position, this adjustment interferes with the sleep of the sleeping partner because of the mattress' one piece construction. To avoid this unpleasant situation, the only recourse has previously been to again push two mattresses together on two separate bed frames with one bed frame being adjustable independently of the other bed frame and the other bed. However, the ever-present split between the two mattresses again causes discomfort throughout the night.

SUMMARY OF THE INVENTION

By the present invention, the problem of a split between two mattresses is eliminated by giving each person on a king-sized bed the capability for adjusting the head and/or foot portion of the mattress to any position, without disturbing the bed partner. A serpentine "S" design is provided to separate the head and foot portions of a single mattress at a distance extending over approximately two feet from the headboard toward the foot of the bed and extending over approximately two feet from the foot of the bed toward the headboard. There is approximately three to four feet of the mattress in a central portion without any separation where most of the body's weight is concentrated and which provides support and comfort for two people in a single king-sized mattress having adjustable head and foot portions.

The serpentine pattern extending from the head and foot of the mattress is of particular importance in providing support to the sleeping partner so as to prevent the partner from encountering or having their arms or legs pass into the split between the two head and/or foot mattress portions. This is accomplished by the undulating portions of the serpentine pattern forming a barrier which is encountered upon movement of the arms or legs towards the separation between the two mattress portions.

It is an object of the present invention to provide a king-sized mattress having separated head and foot portions.

It is another object of the present invention to provide a king-sized mattress having separated head and foot portions which are adjustable in height to various positions.

It is yet another object of the present invention to provide a king-sized mattress having separated head and foot portions which are divided in a serpentine pattern.

It is still yet another object of the present invention to provide a king-sized bed having separated head and foot portions which are adjustable in height and separated by a serpentine pattern to prevent one person sleeping on one side of the mattress from interfering with the sleep of another person sleeping on the opposite side of the mattress.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
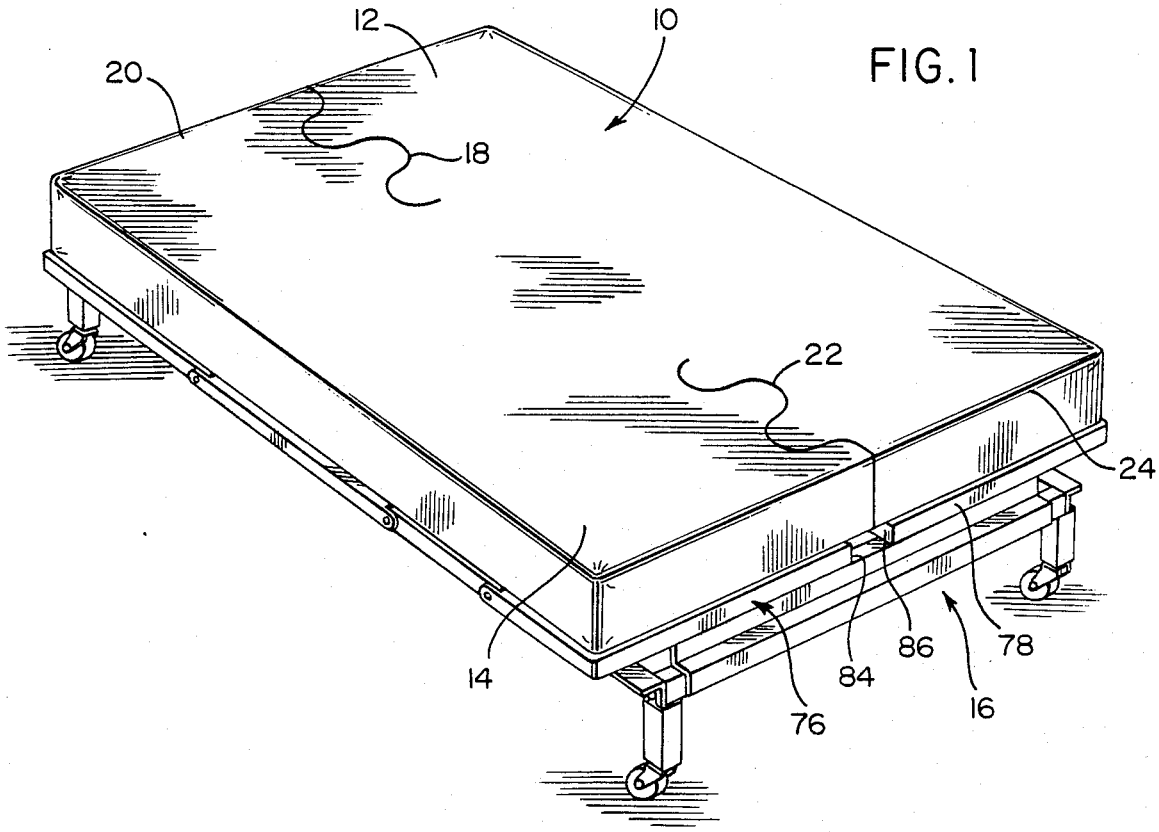
FIG. 1 is a perspective view of a king-sized mattress having separated head and foot portions.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
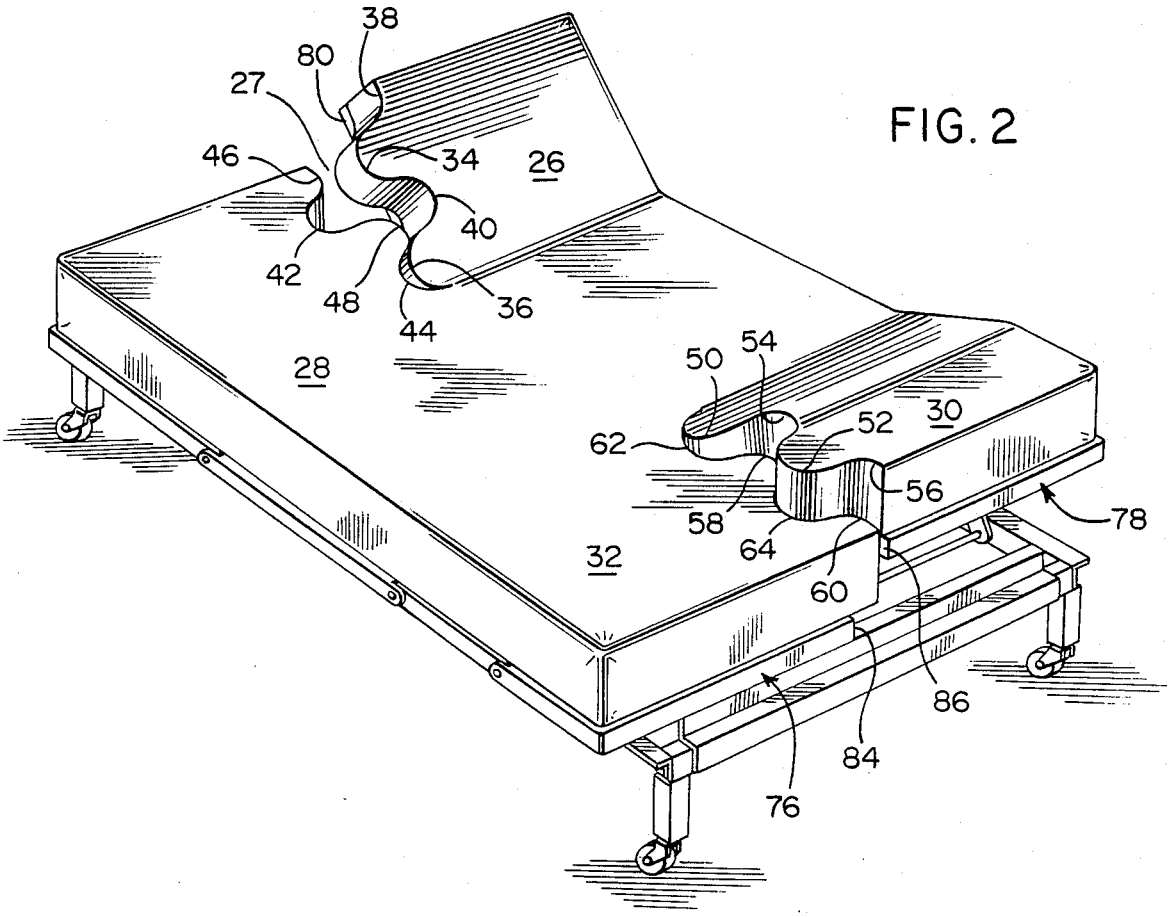
FIG. 2 illustrates a head and foot portion on one side of the mattress in an elevated position.

With reference to the drawings, in general, and to FIGS. 1 and 2, in particular, a king-sized mattress embodying the teachings of the subject invention is generally designated as 10. With reference to its orientation in FIG. 1, the mattress 10 includes a head end 12 and a foot end 14. The mattress 10 is mounted on a frame 16 and includes adjustable elevation head and foot portions.

It is noted that a serpentine-shaped pattern separation 18 extends from the head end 12 of the mattress 10 towards the foot end 14. The separation 18 extends for approximately two feet from the edge 20 of the head end 12. Similarly, a serpentine-shaped separation 22 in an undulating pattern extends from edge 24 of the foot end 14 towards the head end 12 for approximately two feet. The separation 22 extends through the entire thickness of the mattress as does the separation 18.

Frame 16 includes four hospital-type adjustable mechanisms adapted to the mattress 10 of the invention to individually elevate either side of the mattress 10 on either side of the head portion and foot portion of the frame. Upon elevation of the frame mechanism, the height of the head portion and/or foot portion for each side of the mattress is elevatable to different heights.

As shown in FIG. 2, head portion 26 of head end 12 is raised whereas head portion 28 of head end 12 remains horizontal. Similarly, foot portion 30 is elevated whereas foot portion 32 remains horizontal. Upon elevation of either of the head portions 28 or 26 or the foot portions 30 or 32 to different amounts of elevation, the interior edges of the separations 18 and 22 are exposed.

Each of the head portions 26 and 28 includes a series of alternating crests and valleys. For example, included in the separation 18 for the head portion 26 there are two crests 34 and 36 and two valleys 38 and 40. The separation 18 of the head portion 28 is shaped complementary to that of the head portion 26 and includes two valleys 42 and 44 and two crests 46 and 48.

Upon lowering of the head portion 26, the crests and valleys of head portion 26 engage with the crests and valleys of head portion 28 to form the serpentine-shaped separation 18. Likewise at the foot end 14 foot portion 30 includes two crests 50 and 52 and two valleys 54 and 56 which are shaped complementary to the opposing crests 58 and 60 and valleys 62 and 64 of foot portion 32.

It is important to note that by the serpentine pattern provided by separations 18 and 22, if one of the head portions 26 or 28 is elevated above the other, the person lying on the lower-most head portion will be prevented from having a body part entering the separation 18 by contacting the crests of the elevated head portion. Similarly, for the foot portions 30 and 32, if one foot portion is elevated above the other, the projecting crests will prevent a body part from entering the separation 22.

In FIG. 2, this concept is disclosed by head portion 26 being elevated above head portion 28. Crests 34 and 36 project from head portion 26 to aid in preventing a body part of someone lying on head portion 28 from entering the gap between the elevated head portion 26 and the horizontally located head portion 28. Similarly, foot portion 30 is elevated above foot portion 32 and crests 50 and 52 tend to prevent the person who is lying on foot portion 32 from entering the separation 22 which separates the two foot portions.

Figure 3:
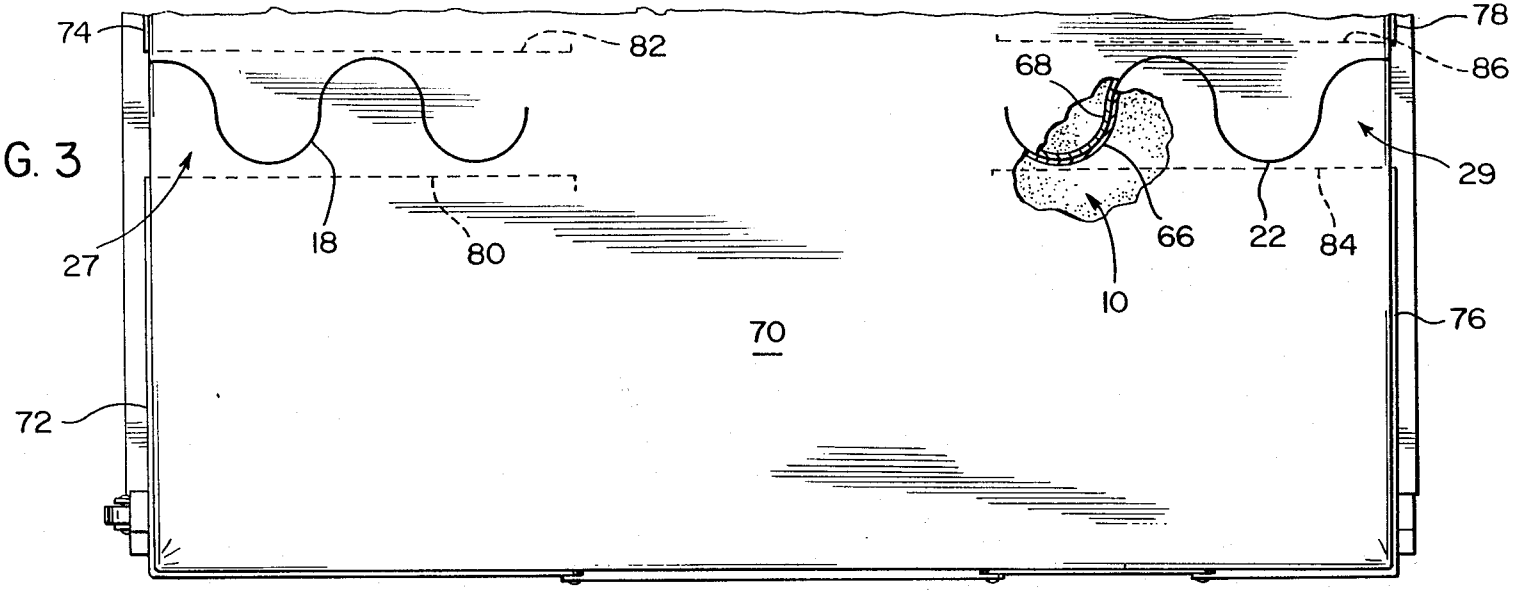
FIG. 3 is a partial sectional view of the serpentine pattern separation located at opposite ends of the mattress.

Further, even if a body part of someone lying on a lower elevation of the head portion or foot portion were to enter a gap 27, for example as shown in FIG. 2, between head portions 26 and 28, due to the serpentine pattern of the separation 18, the person would necessarily avoid contacting the bed frame elevation mechanism for raising the head portion 26 because of the offset bed frame elevation mechanisms for each of the portions 26 and 28. The bed frame elevation mechanisms are offset, as shown in FIG. 3 due to the crests of serpentine-shaped separations projecting towards an opposed head or foot portion. The frame elevation mechanism must therefore be recessed to avoid contacting the crests of the adjacent head or foot portion during elevation of a head or foot portion. The chances of someone contacting the frame mechanism used for elevation of the head portion 26 is thereby eliminated.

When the head portions and foot portions of the mattress are at the same elevation as shown in FIG. 1, the serpentine-shaped separations 18 and 22 are easily rolled over while supporting the person rolling over the separations 18 and 22. This result was not possible with a mattress having a straight-line separation.

Figure 4:
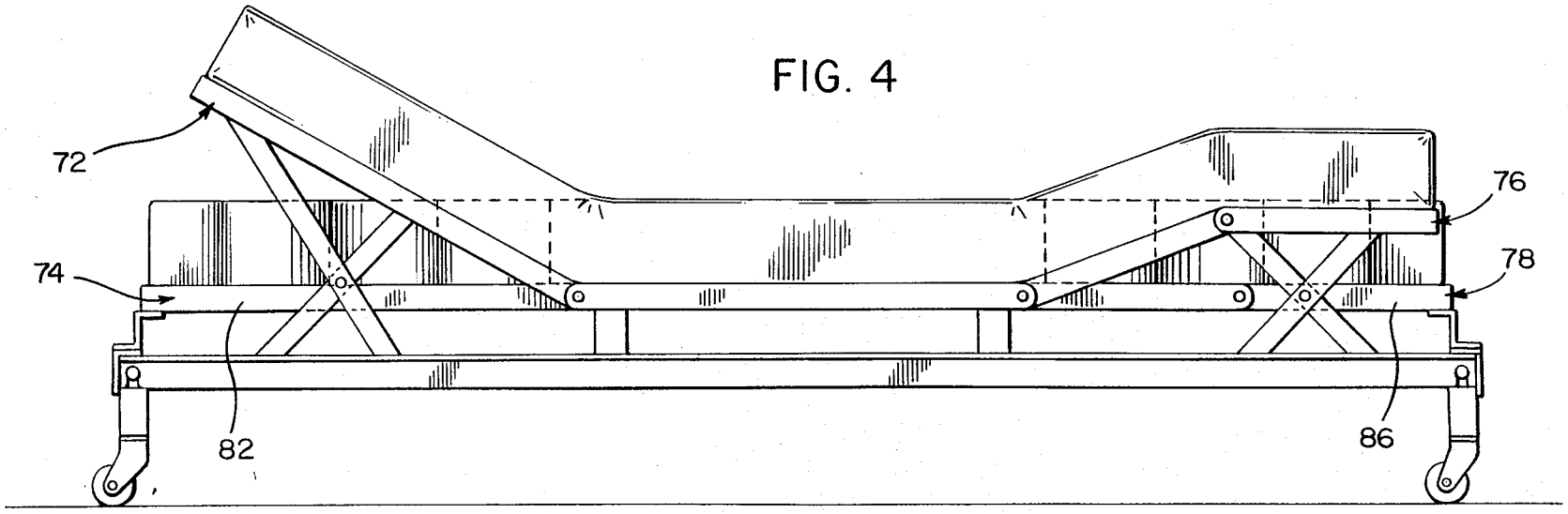
FIG. 4 is a side view of the head and foot portions of the mattress in an elevated position.

In FIG. 4, the separate elevation of the head and foot portions are shown. The frame 16 includes separate elevation mechanisms 72 and 74 for each of the head portions 26 and 28, respectively, and separate elevation mechanisms 76 and 78 for the foot portions 30 and 32, respectively.

In FIG. 3, the side edges 66 and 68 of the sheet 70 which surrounds the mattress 10 is shown. By the partial sectional view of FIG. 3, the sheet 70 is shown to be specially designed to surround the mattress 10, including the separations 18 and 22.

In FIG. 3, the separate bed frame elevation mechanisms 72, 74, and 78 are shown in dotted lines extending underneath the mattress 10. The gap 27 shown in FIG. 2 is formed between the edge 80 shown in dotted lines for the adjustment mechanism 72 and the edge 82 for the adjustment mechanism 74. Similarly, a gap 29 is shown between the edges 84 and 86 for the adjustment mechanism 76 and 78 respectively. It is seen that the serpentine-shaped separations 18 and 22 extend between edges 80, 82 and 84, 86 respectively.

Having described the invention, many modifications thereto will become apparent to those skilled in the art to which it pertains without the deviation from the spirit of the invention as defined by the scope of the appended claims.

I claim:

1. A mattress comprising:

a head end, a foot end, and a central portion located between said head end and said foot end, said head end including a centrally-located head end separation for dividing said head end into two head portions, said head end separation extending from said head end towards said foot end and terminating at said central portion, said separation extending in a serpentine pattern to form a series of complementary-shaped crests and valleys on said two head portions, said foot end including a centrally-located foot end separation for dividing said foot end into two foot portions, said foot end separation extending from said foot end towards said head end and terminating at said central portion, said separation extending in a serpentine pattern to form a series of complementary-shaped crests and valleys on said two foot portions.

2. A mattress as claimed in claim 1, wherein the mattress is a king-sized mattress.

3. A mattress as claimed in claim 1, wherein said two head portions are elevatable independently of one another.

4. A mattress as claimed in claim 1, wherein said two foot portions are elevatable independently of one another.

5. A bed comprising:

a bed frame, a mattress located on said bed frame, said mattress including a head end, a foot end and a central portion located between said head end and said foot end, said head end including a centrally-located head end separation for dividing said head end into two head portions, said head end separation extending from said head end towards said foot end and terminating at said central portion, said separation extending in a serpentine pattern to form a series of complementary-shaped crests and valleys on said two head portions, said foot end including a centrally-located foot end separation for dividing said foot end into two foot portions, said foot end separation extending from said foot end towards said head end and terminating at said central portion, said separation extending in a serpentine pattern to form a series of complementary-shaped crests and valleys on said two foot portions.

6. A bed assembly as claimed in claim 5, wherein said bed frame includes adjustment means for elevating said two head portions independently of each other and for elevating said two foot portions independently of each other.

7. A bed assembly as claimed in claim 6, wherein said adjustment means for said two head portions includes an adjustment assembly for each of said two head portions, said adjustment assembly for each of said two head portions being spaced from each other to form a gap therebetween so that when one adjustment assembly elevates one head portion, said one adjustment assembly lifts only said one head portion and said one head portion thereby clears the crests and valleys of said other head portion.

* * * * *